US007658342B2

(12) United States Patent
Chang

(10) Patent No.: US 7,658,342 B2
(45) Date of Patent: Feb. 9, 2010

(54) AUTO-FEED BUIT-IN A PAPER SHREDDER

(75) Inventor: Frank Chang, SanChung (TW)

(73) Assignee: Michilin Prosperity Co., Ltd., Taipei Hsien (TW)

( * ) Notice: Subject to any disclaimer, the term of this patent is extended or adjusted under 35 U.S.C. 154(b) by 0 days.

(21) Appl. No.: 10/866,145

(22) Filed: Jun. 14, 2004

(65) Prior Publication Data

US 2005/0274836 A1 Dec. 15, 2005

(51) Int. Cl.
*B02C 13/00* (2006.01)
*B02C 17/02* (2006.01)
*B07C 7/00* (2006.01)

(52) U.S. Cl. ..... 241/81; 241/225

(58) Field of Classification Search ..... 241/36, 241/236, 81, 225
See application file for complete search history.

(56) References Cited

U.S. PATENT DOCUMENTS 4,817,877 A * 4/1989 Itoh et al. ..... 241/34
4,821,967 A * 4/1989 Moriyama ..... 241/37.5
4,964,579 A * 10/1990 Strohmeyer ..... 241/100
5,354,001 A * 10/1994 Hasegawa ..... 241/34
6,021,598 A * 2/2000 Holton ..... 47/9

* cited by examiner

*Primary Examiner*—Bena Miller
(74) *Attorney, Agent, or Firm*—Venable LLP; Roy A. Kim

(57) ABSTRACT

Disclosed is an auto-feed built-in a paper shredder, including a pair of bisecting lids that are each provided at an inside thereof with a paper press, a paper receiving compartment, an auto-feed, and a paper shredding device located exactly below the auto-feed, wherein the auto-feed includes a paper tray, a paper inlet and two roller assemblies; the paper inlet and the paper shredding device located therebelow are aligned along an identical central axis; the two roller assemblies are provided at opposing sides of the paper inlet in parallel and project into the paper tray, whereby after placing a pile of paper into the paper receiving compartment to be supported by the paper tray, and closing the bisecting lids, the paper presses provided at the insides of the lids would apply a force against the pile of paper, such that a bottommost paper of the pile of paper would be folded in half by the two rollers rotating towards each other and then fed into the paper inlet to be subsequently shredded by the paper shredding device located below the paper inlet.

1 Claim, 4 Drawing Sheets

AUTO-FEED BUIT-IN A PAPER SHREDDER

CROSS-REFERENCES TO RELATED APPLICATIONS

Not Applicable

STATEMENT REGARDING FEDERALLY SPONSORED RESEARCH OR DEVELOPMENT

Not Applicable

DESCRIPTION

1. Field of Invention

This invention relates to an auto-feed built-in a paper shredder, particularly to one allowing a user to place a large amount of waste paper to be shredded into a paper receiving compartment in a pile, which paper is then fed into an auto-feed to be shredded by a paper shredding device.

2. Background of Invention

It is widely known that paper shredders for shredding incorporate plural cutting blades and spacers passing through rotary shafts that are driven to rotate towards each other by a motor and gear box so as to shred paper passing. through the rotary shafts into strips by shear forces.

The maximum sheet capacity of the conventional paper shredders is dependent on the motor load and the limitations of the cutting blades and rotary shafts. Thus, when a large amount of paper is to be destroyed, the user must continuously feed the paper that is within the maximum sheet capacity of the paper shredded into the paper shredder manually in order to destroy the entire batch of documents.

Paper shredders may provide a peripheral auto-feed that would allow automatic feeding of multiple pieces of paper into paper shredder for shredding, such as that disclosed in TW414725 disclosing a paper feeder capable of automatically feeding documents or piles of paper into a shredder for shredding. The paper includes a pivotal driving roller assembly and a swingable top support. The pivotal driving roller assembly includes a driving roller and a pivotal roller for providing a driving force below a pile of paper, thereby separating a small pile of paper from the entire pile, and advancing the small pile of paper into a paper shredder located at downstream for shredding. U.S. Pat. No. 5,362,002 discloses a paper shredder with automatic paper feeding device The feeding device includes a tray which is mounted to the casing adjacent to the shredding roller assembly, a rotary shaft which is mounted rotatably on the tray, a tension spring which is connected to the rotary shaft and the tray, and at least one push rod, each of which having two pivotally connected rod sections. A first one of the rod sections is mounted on the rotary shaft, while a second one of the rod sections is provided with a press piece which presses against a stack of paper sheets on the tray. The feeding device further includes a pinion which is mounted securely on one end of the rotary shaft, and a wheel which has a sector portion formed with gear teeth and which is driven rotatably by the motor driving unit so as to drive rotatably and intermittently the pinion to rotate correspondingly the rotary shaft against action of the tension spring to cause movement of the press piece and some of the paper sheets toward the shredding roller assembly. Further, the co-owned U.S. Pat. No. 5,884,855 discloses a paper feed structure for paper shredders having a paper bearing device and paper feed adjustment device. The paper feed structure includes oblique paper bearing plate disposed above wheel cutters of the paper shredder, a paper feed adjustment device, an infrared shielded switch having the function of actuating the paper shredder, a paper feed roller, and slidable plates. Paper need not be fed one by one into the paper shredder manually, and the paper feed amount is adjustable. A pile of paper can be placed on the paper bearing device and the paper is automatically fed into the paper shredder one by one.

The paper feeders and paper shredders described above are in fact independent devices. That is, the paper shredders are peripheral devices that are added to the paper shredders and adopt structure that is similar to the paper feeding tray adopted by the conventional printers. Thus, upon placing a pile of paper in a paper tray, the paper feeder will utilize gear boxes, rods or conveyors to advance the leading edge of the bottommost paper into an inlet of the paper shredder. In other words, such paper feeders require the use of additional motor driving units and driving components and thus involve higher manufacturing cost. In addition, they require space that is beyond that occupied by the paper shredder casing, such that they lack a unified appearance while failing to fulfill their maximum efficacy within minimum space.

Thus, it is essential to provide an auto-feed that is built-in a paper shredder casing so as to reduce the space as occupied by the paper shredder and paper feeder.

SUMMARY OF INVENTION

It is a primary objective of this invention to provide an auto-feed built-in a paper shredder that is integrated into the paper shredder so as to reduce the space as occupied by the paper shredder and paper feeder.

It is another objective of this invention to provide an auto-feed built-in a paper shredder that shares a common motor driving unit and driving components with the paper shredder so as to reduce the number of components and the manufacturing cost.

To resolve the shortcoming of the prior art and to achieve the above objectives, this invention discloses an auto-feed built-in a paper shredder, including a pair of bisecting lids that are each provided at an inside thereof with a paper press, a paper receiving compartment, an auto-feed, and a paper shredding device located exactly below the auto-feed, wherein the auto-feed includes a paper tray, a paper inlet and two roller assemblies; the paper inlet and the paper shredding device located therebelow are aligned along an identical central axis; the two roller assemblies are provided at opposing sides of the paper inlet in parallel and project into the paper tray, whereby after placing a pile of paper into the paper receiving compartment to be supported by the paper tray, and closing the bisecting lids, the paper presses provided at the insides of the lids would apply a force against the pile of paper, such that a bottommost paper of the pile of paper would be folded in half by the two rollers rotating towards each other and then fed into the paper inlet to be subsequently shredded by the paper shredding device located below the paper inlet.

BRIEF DESCRIPTION OF THE DRAWINGS

These and other modifications and advantages will become even more apparent from the following detailed description of a preferred embodiment of the invention and from the drawings in which.

DETAILED DESCRIPTION OF THE INVENTION (PREFERRED EMBODIMENTS)

The paper shredding device for shredding paper adopted by this invention is not limited to the conventional stripe-cut type or cross-cut type shredders. However, to prevent overfilling the wastebasket for containing the paper shreds in a short period of time, it is preferred that the paper shredding device is capable of shredding the paper into fragmentary pieces.

Figure 1:
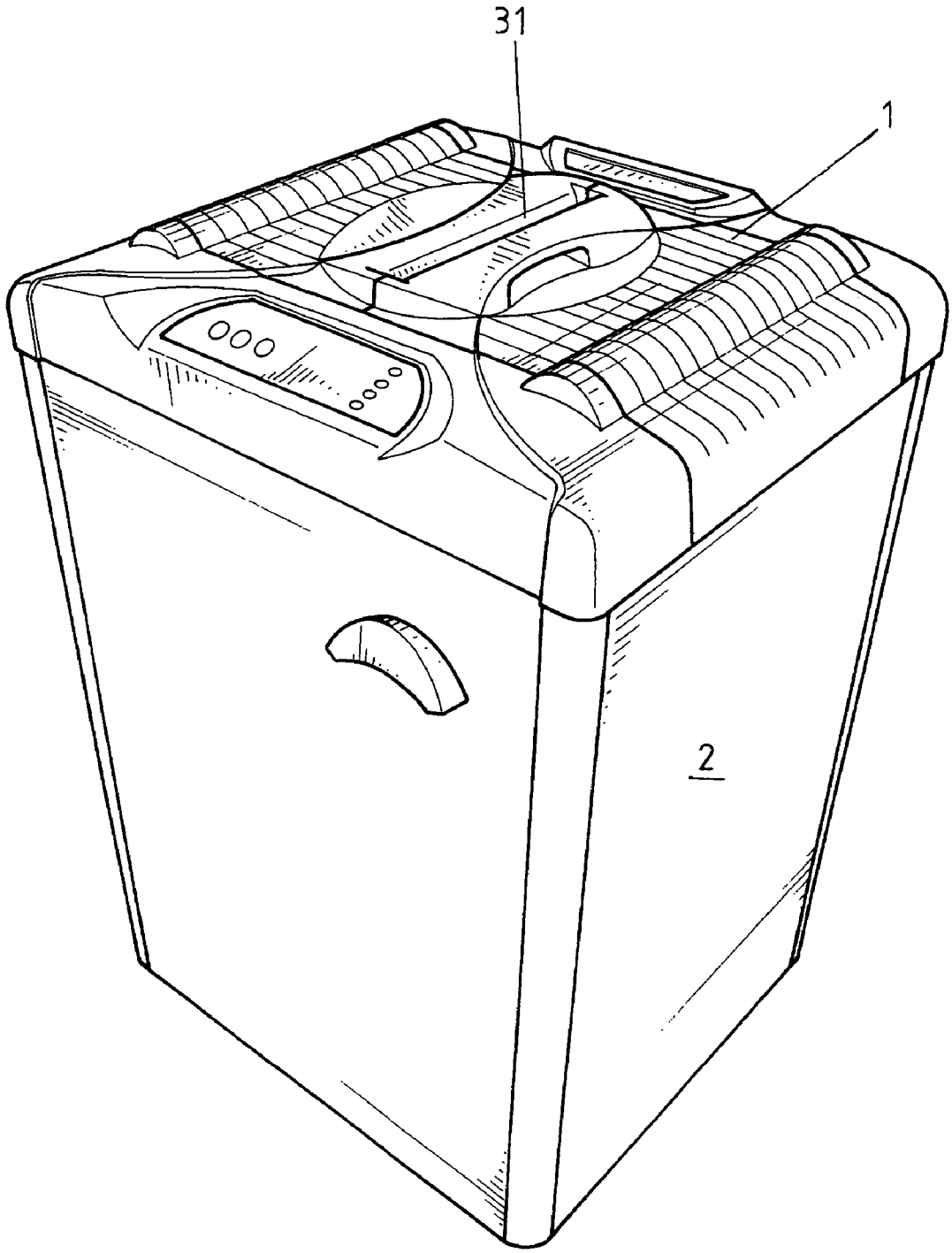
FIG. 1 is a schematic drawing illustrating the appearance of an auto-feed built-in a paper shredder according to this invention.
Figure 2:
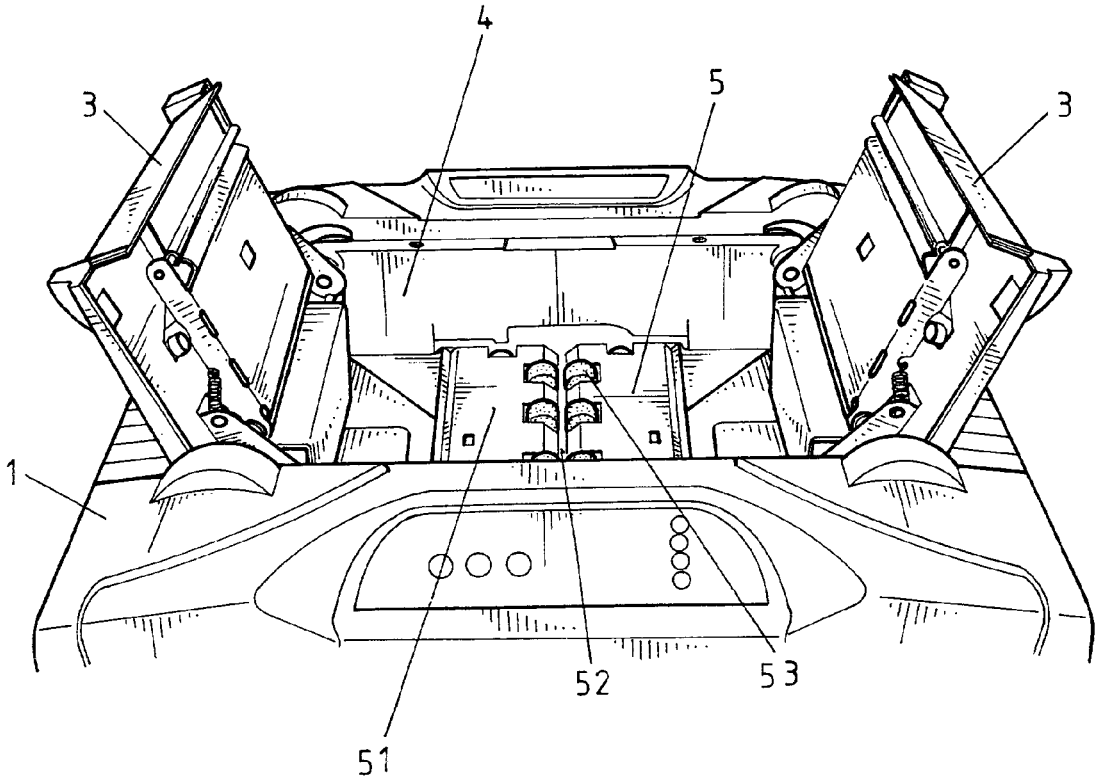
FIG. 2 is a schematic drawing illustrating the appearance of the bisecting lids of the auto-feed built-in a paper shredder according to this invention.

FIG. 1 is a schematic drawing illustrating the appearance of an auto-feed built-in a paper shredder according to this invention. The built-in auto-feed includes paper shredder 1 for shredding paper and a wastebasket 2 for receiving paper shreds. As shown in FIG. 2, the paper shredder 1 includes a pair of bisecting lids 3, a paper receiving compartment 4, an auto-feed 5 and a paper shredding device 6 located exactly below the auto-feed. The paper shredding device 6 may adopt the conventional construction of using plural cutting blades 61 and spacers (not shown) passing through rotary shafts 62 that are driven to rotate towards each other by a motor and gear box 63 so as to shred paper passing through the rotary shafts 62 into strips by shear force.

Figure 3:
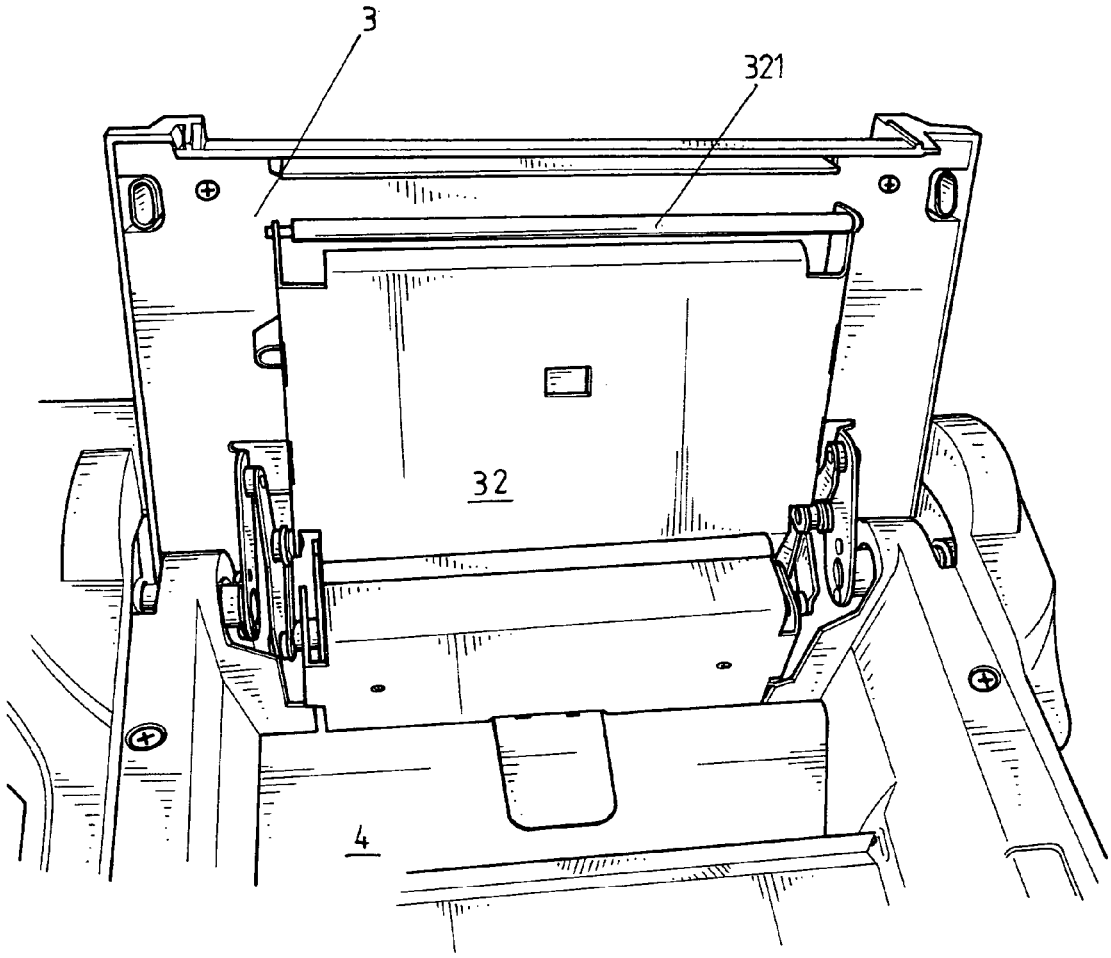
FIG. 3 is a schematic drawing illustrating the appearance of the link paper press adopted by the lids of the auto-feed built-in a paper shredder according to this invention.
Figure 4:
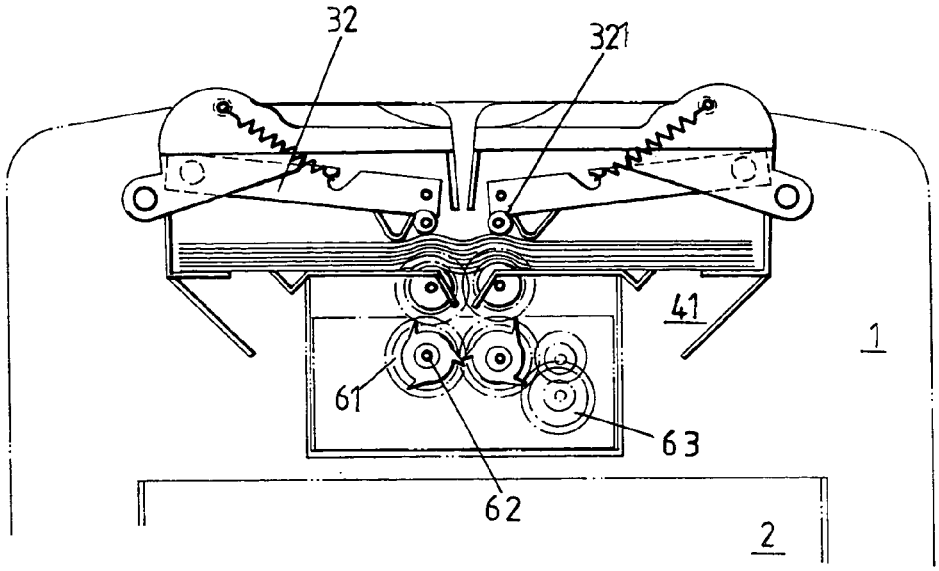
FIG. 4 is a schematic view illustrating the state feeding paper for the auto-feed built-in a paper shredder according to this invention.
Figure 5:
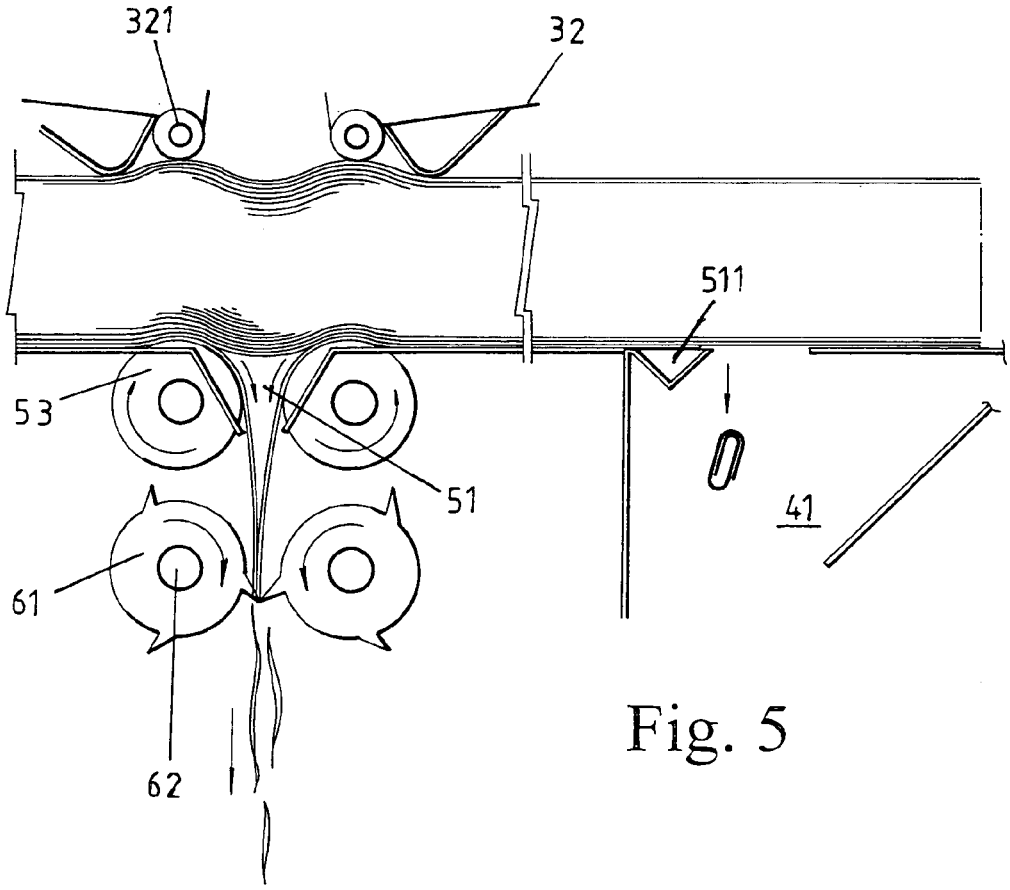
FIG. 5 is a schematic view illustrating the paper path for the auto-feed built-in a paper shredder according to this invention.

The bisecting lids 3 are formed with a paper inlet slot 31 at their interface upon closing. The paper inlet slot 31 and paper shredding device 6 are located along an identical central axis such that a small amount of waste paper may be inserted through the paper inlet slot 31 and then subsequently shredded by the paper shredding device 6. With reference to FIGS. 3 to 5, any of the lids 3 is provided at an inside thereof with a link paper press 32, such that upon closing the lids 3, a movable pressing rod 321 located at a leading edge of the paper press 32 will apply a load against the paper to be shredded due to the structure of the link so as to press the paper to be shredded downwards. The details of the lids and the link paper press will be described in an alternative patent application co-owned by the applicant.

The paper receiving compartment 4 serves to contain a pile of paper to be shredded:

The auto-feed 5 is located at a bottom of the paper receiving compartment 4 and includes a paper tray 5 1, a paper inlet 52 and two roller assemblies 53. The paper inlet 52 and the paper shredding device located below the paper inlet 52 are aligned along an identical central axis. The two roller assemblies 53 are provided at opposing sides of the paper inlet 52 in parallel and project into the paper tray 51. The roller assemblies 53 are driven by the motor and gear box 6 that drives the paper shredding device in synchronous such that the roller assemblies 53 and the paper shredding device 6 are in parallel and rotate in identical directions to maintain consistent paper feeding and shredding speeds thereby preventing paper jam or idle running.

The paper tray 51 is formed at opposing ends thereof V-notches 511, as shown in FIG. 5, for sweeping away paper clips that serve to clip the documents into drop openings 41 formed on the opposing sides of the paper receiving documents when the paper subject to pressing force is introduced towards the paper inlet, so as to prevent the paper clips from damaging the blades 61 upon entering the paper shredding device 6.

With reference to FIGS. 4 and 5, after placing a pile of paper into the paper receiving compartment 4 to be supported by the paper tray 51, and closing the bisecting lids 3, the movable pressing rod 321 located at a leading edge of the paper press 32 will apply a load against the paper to be shredded due to the structure of the link so as to press the paper to be shredded downwards. As such, the bottommost paper of the pile of paper that is originally in a flat configuration would be folded in half by the two roller assemblies 53 rotating towards each other and then fed into the paper inlet 52 to be subsequently shredded by the paper shredding device 6 located below the paper inlet 52. The above operations of feeding paper are repeated until the entire pile of paper received in the paper receiving compartment has been folded in half and fed into the paper inlet to be shredded by the paper shredding device one by one.

In practice, the paper shredder of this invention may be provided with a manual switch that would activate the motor and gear box upon a user switch the manual switch on. The paper shredder may also be featured with a contact switch or an optical sensor that is provided at the paper inlet and electrically connected to the motor and gear box, such that after closing the bisecting lids and upon sensing existence of paper in the paper receiving compartment, the motor and gear box will be activated automatically.

Because the auto-feed of a paper shredder according to this invention is built-in a paper shredder casing and integrated into the paper shredder, the space required by the paper shredder and the auto-feed is reduced while featuring the paper shredder with an aesthetic appearance. In addition, the auto-feed of a paper shredder according to this invention shares a common motor driving unit and driving components with the paper shredder so as to reduce the number of components and the manufacturing cost thereby improving the market competitiveness of the paper shredder.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An apparatus for shredding paper having a paper shredder and a wastebasket, the paper shredder having a pair of bisecting lids that are each provided at an inside thereof with a paper press; a paper receiving compartment; an auto-feed, and a paper shredding device located exactly below the auto-feed; characterized in that:

the auto-feed is located exactly below a bottom of the paper receiving compartment and includes:

a paper tray;

a paper inlet being aligned along an identical central axis with the paper shredding device located below the paper inlet; and two roller assemblies, provided at opposing sides of the paper inlet in parallel and projecting into the paper tray, the roller assemblies being arranged to be in parallel with the paper shredding device located below the roller assemblies, and driven by a motor and gear box that drives the paper shredding device in synchronous such that the roller assemblies and the paper shredding device rotate in identical directions to maintain consistent paper feeding and shredding speeds; and wherein the paper tray of the auto-feed is provided at opposing ends thereof with V-shaped clip-sweeps and drop openings formed on the opposing sides of the paper receiving compartment to prevent paper clips from damaging the paper shredding device.

* * * * *